United States Patent [19]

Sawizky et al.

[11] Patent Number: 4,810,166

[45] Date of Patent: Mar. 7, 1989

[54] CONTROLLABLE PITCH MARINE PROPELLER

[75] Inventors: Paul A. Sawizky, Norwood; Stephen C. Olson, Norfolk; Ole H. Midttun, Walpole, all of Mass.

[73] Assignee: Bird-Johnson Company, Walpole, Mass.

[21] Appl. No.: 80,791

[22] Filed: Aug. 3, 1987

[51] Int. Cl.[4] ..... B63H 3/08; B63H 3/04

[52] U.S. Cl. ..... 416/167; 416/146 A; 416/164

[58] Field of Search ..... 416/167, 162, 166, 153, 416/154, 146 A, 146 B, 157 R, 159, 163–164, 49, 156, 147

[56] References Cited

U.S. PATENT DOCUMENTS

| | | | |
|---|---|---|---|
| 1,008,953 | 11/1911 | Clennell et al. | 416/167 |
| 1,133,222 | 3/1915 | Bevis | 416/166 |
| 1,832,075 | 11/1931 | Wilson | 416/167 |
| 2,360,982 | 10/1944 | Sahle | 416/166 |
| 2,517,714 | 8/1950 | Roesch | 416/147 |
| 3,232,350 | 2/1966 | Lorenz | 416/167 |
| 3,501,251 | 3/1970 | Haglund et al. | 416/154 X |
| 3,802,800 | 4/1974 | Merkx et al. | 416/157 R |
| 4,028,004 | 6/1977 | Wind | 416/157 R |
| 4,599,043 | 7/1986 | Müller | 416/167 X |

FOREIGN PATENT DOCUMENTS

| | | | |
|---|---|---|---|
| 557801 | 6/1957 | Belgium | 416/159 |
| 560626 | 4/1975 | Switzerland | 416/146 A |
| 860205 | 2/1961 | United Kingdom | 416/146 A |

*Primary Examiner*—Everette A. Powell, Jr.
*Attorney, Agent, or Firm*—Brumbaugh, Graves, Donohue & Raymond

[57] ABSTRACT

A controllable pitch marine propeller comprises a hub body carrying a plurality of propeller blades for rotation about pivot axes disposed radially of the hub axis, a force rod extending into the hub body from the propeller shaft, and a cross-head affixed to the force rod and coupled to each propeller blade by a pin and slideway such that the propeller pitch is controlled by fore and aft movements of the force rod. The hub body has a tubular mount spigot that receives the aft end of the shaft with the shaft and mount spigot terminating aftward of the pivot axes of the blades. The cross-head is generally cup-shaped, having a base portion affixed to the force rod aftward of the pivot axes of the blades and a tubular portion extending forewardly from the base portion and surrounding aftward portions of the spigot in telescoping relation. The cross-head in supported in plain bearing relation by the hub body for fore and aft movements.

1 Claim, 3 Drawing Sheets

CONTROLLABLE PITCH MARINE PROPELLER

BACKGROUND OF THE INVENTION

Controllable pitch marine propellers provide numerous advantages over fixed pitch propellers, especially in vessels that operate at various speeds with varying loads. A well-known form of controllable pitch propeller is the force rod type, in which a blade pitch control mechanism in the propeller hub is operated by a force rod that extends through the shaft and is moved forward and aftward by an inboard hydraulic servo or other suitable means. The pitch-control mechanism in the hub comprises a cross-head affixed to the aft end of the force rod and coupled to each of the blades by crank pins and slideways. In some designs the slideways are on the cross-head and the pins on the blade mounts. In other designs the pins are on the cross-head and work in corresponding slideways on the blade mounts. The blades are, of course, mounted on the hub for rotation about pivot axes disposed radially of the propeller shaft axis, and the crank pins and slideways are offset generally circumferentially from the pivot axes of the blades.

In the majority of present designs of force rod type controllable pitch propellers, the cross-head is generally a block of metal attached to the end of the force rod and containing slideways for each crank pin sliding shoe. It is located within the propeller hub such that at a neutral (zero pitch) position it lies radially inwardly of the blade-mounting trunions. Upon movements for ahead and astern pitch control the cross-head moves forward and aftward from the neutral position. With this configuration, the open region of the hub swept by the cross-head in its pitch-controlling motions has to be aftward of the aft end of the shaft. Accordingly, the shafting and aftmost shaft bearing have to be designed to carry a substantial overhung moment due to the load of the propeller, which is located almost entirely aftward of the aft end of the shaft.

SUMMARY OF THE INVENTION

A technological objective of the present invention is to reduce the overhung moment of a force-rod type controllable pitch propeller, thereby enabling a reduction in shafting stress, or the use of smaller shafting, and decreased loading on the aftmost shaft bearing. A further objective is to provide a controllable pitch propeller having a significantly shorter hub and a minimum number of components. It is, moreover, desired to construct the propeller in a way that makes it easy to assemble and to disassemble for repair and service.

In common with known controllable pitch propellers a propeller embodying the present invention comprises a hub body carrying a plurality of propeller blades for rotation about pivot axes disposed radially from the hub and shaft axis and adapted to be mounted on the tail end of a tubular propeller shaft. A force rod is received within the shaft for forward and aftward movement and extends into the hub body beyond the tail end of the shaft. A cross-head affixed to the force rod is coupled to a crank pin on each blade, whereby the blades can be rotated about their pivot axes to alter the blade pitch by fore and aft movements of the force rod.

The invention is characterized in that the hub body has a generally tubular mounting spigot receiving the aft end of the propeller shaft with the spigot and shaft terminating aftward of the axes of rotation of the blades, in that the cross-head is generally cup-shaped, having a base portion affixed to the force rod aftwardly of the mounting spigot and shaft and a flange portion extending forward from base portion and surrounding aftward portions of the spigot and shaft in telescoping relation, and in that the cross-head is supported in bearing relation for forward-aftward movement by the hub body.

The invention is, preferably, further characterized in that the cross-head flange portion has internal surfaces forming plain bearings with external surfaces of the propeller mounting spigot and in that the cross-head has external surfaces forming plain bearings with internal surfaces of the hub body located aftward of the aft end of the propeller shaft.

For a better understanding of the invention, reference may be made to the following description of an exemplary embodiment, taken in conjunction with the accompanying drawings.

DESCRIPTION OF THE EMBODIMENT

Figure 1:
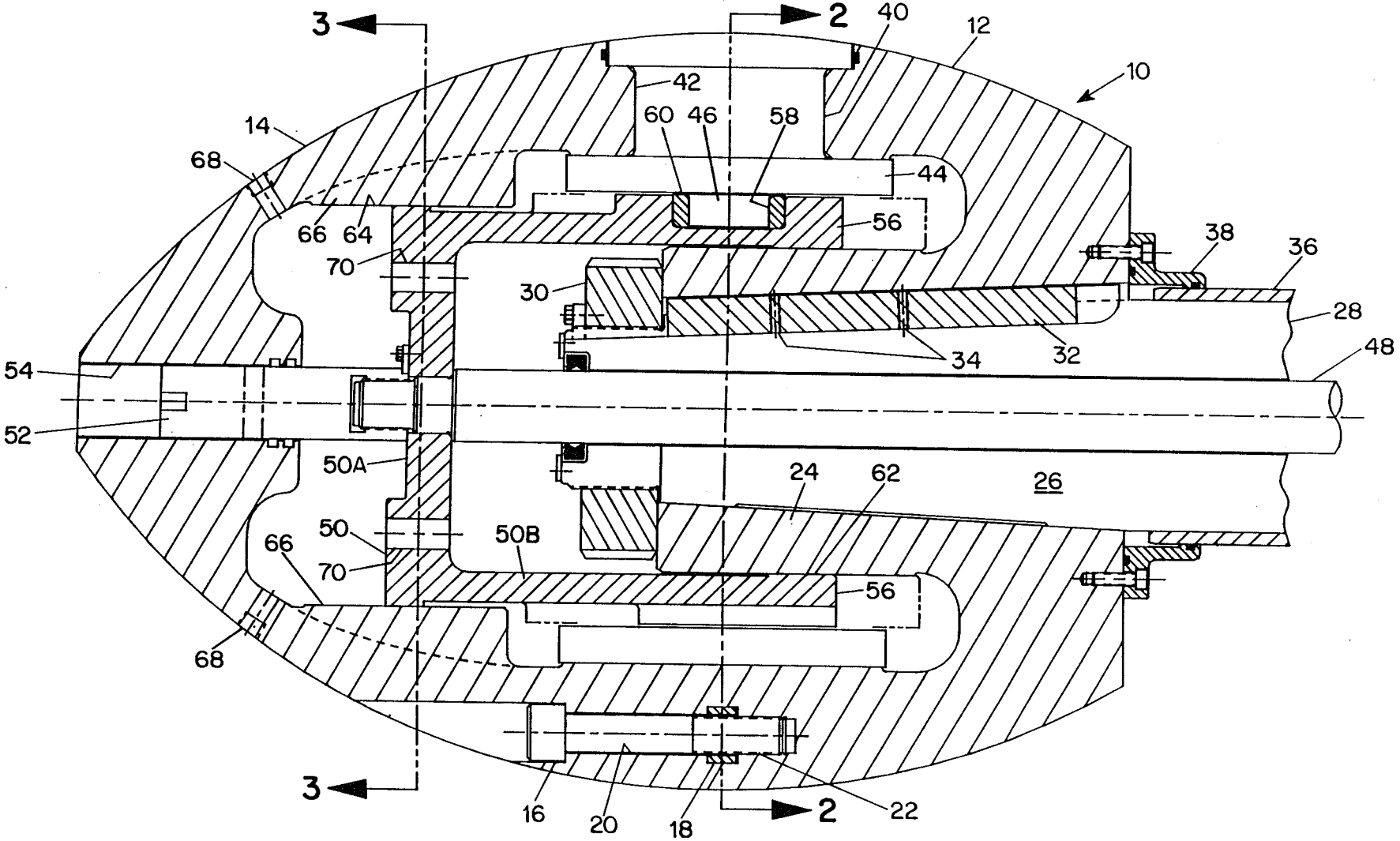
FIG. 1 is a side cross-sectional view taken along a broken plane, which is represented generally by the lines 1—1 of FIG. 2.

The embodiment comprises a two-piece hub body 10 consisting of a forward section 12 and an aftward section 14 that meet along a plane defined by the pivot axes of the blades, which is coincident with the section line 2-2 of FIG. 1. The hub sections are joined by bolts 16, and assembly and exact register of the sections are facilitated by hollow dowels 18 partly received in the bolt holes 20 and 22. The external surface of the hub is suitably streamlined for minimum drag.

The forward section 12 of the hub body has an internal tubular mount spigot 24 that extends aftward to a terminus or tail that is to the aft of the plane of the blade pivot axes. The tapered tail end portion 26 of the propeller shaft 28 is received in the spigot 24 and secured axially by a large nut 30 and rotationally by a key 32. (The holes 34 in the key are for jacking the key out of the keyway in the shaft.) It is also possible, and known, to provide frictional affixation of the hub to the shaft against relative rotations by sufficient drive-up of the hub and providing a suitable taper on the shaft and spigot. The shaft 28 receives a bronze sleeve 36, which is sealed to the hub section 12 by a sealing ring 38.

The blades of the propeller are not shown in the drawings, but it is readily apparent that they extend out from trunions 40 received for rotation in mounting sockets 42 in the hub body and retained radially in place by crank ring portions 44 received within the internal cavity of the hub body. A crank pin 46 projects inwardly into the hub cavity from the crank ring of each blade. In the embodiment the blade, trunion and crank ring are integral (unitary), but they could well be separate elements assembled with bolts. In the neutral (zero pitch) settings of the blades, the crank pins are offset circumferentially from the blade pivot axes and are centered substantially on the plane of the pivot axes—this position is shown in the drawings.

A force rod 48 extends through the shaft 28 from an inboard hydraulic servo (not shown) or other suitable drive device for moving it forward and aftward. A cross-head 50 is fastened by a special long nut 52 whose dual purpose is to provide volume compensation for the force rod 48, and is received in a hole 54 in the aftward section 14 of the hub body. The cross-head is generally cup-shaped, in that it includes a round disc-like base portion 50A and a tubular portion 50B extending forward from the perimeter of the base portion. The tubular portion 50B transforms to a square shape on its outside forming protecting boss portions 56 on the forward end.

At the location of each of the crank pins 46, each boss portion 56 has a slideway 58 oriented transversely of the shaft axis, and each slideway receives a sliding shoe 60 that, in turn, accepts the crank pin. When the force rod and cross-head are pulled forward from the neutral position, the blades are rotated counter-clockwise, which is the preferred mode to adjust the blades to deliver astern thrust. (The design can be readily modified to produce the opposite effect, i.e., aft movement of the force rod causing counter clockwise blade rotation to deliver ahead thrust.) Conversely, when the force rod is pushed aftward, the blades are pivoted to deliver ahead thrust. The servo is suitably controlled to provide infinite settings between maximum pitches for astern and ahead thrusts. The maximum cross-head travel is indicated in partial phantom lines of the boss portions 56 in FIG. 1.

Figure 2:
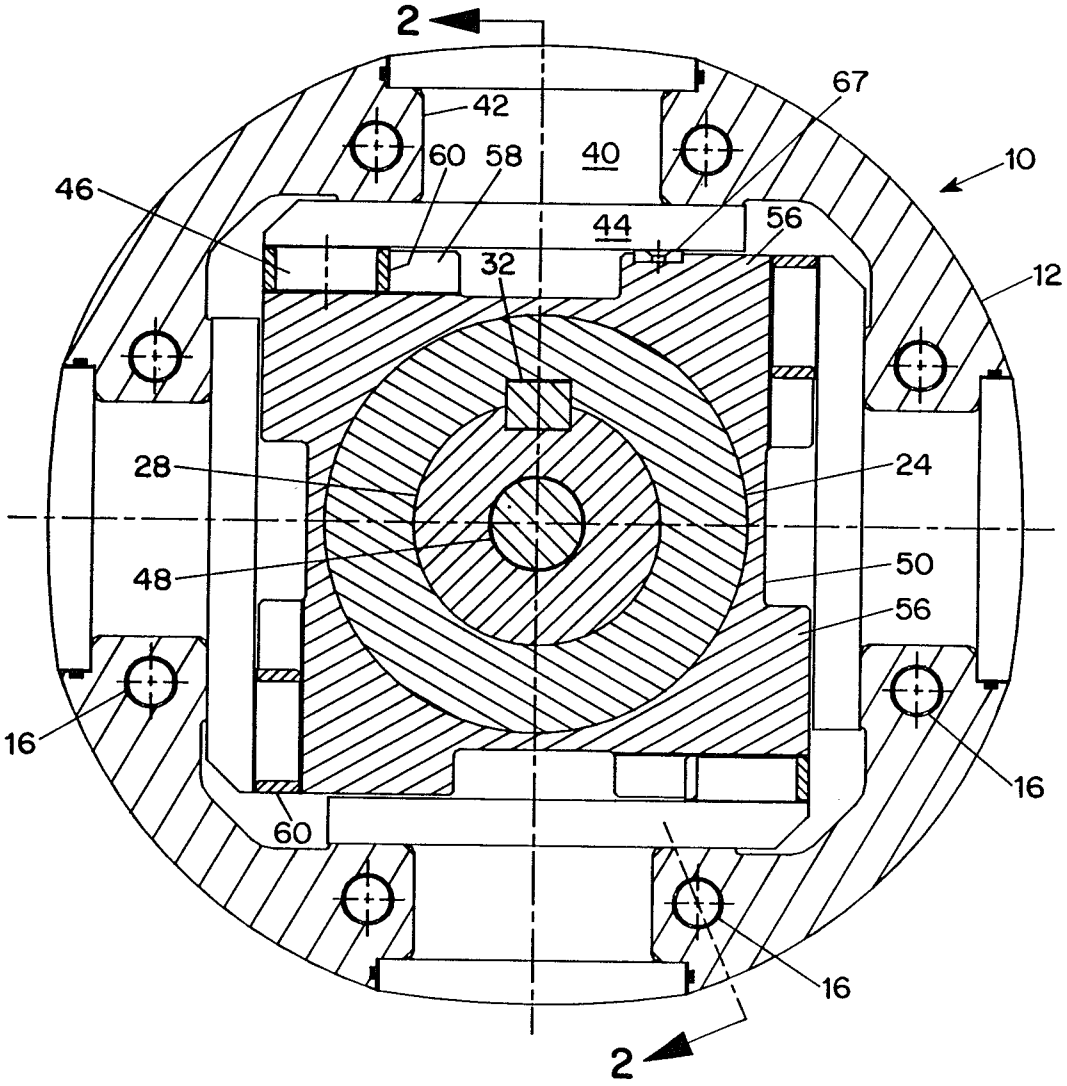
FIGS. 2 and 3 are end cross-sectional views taken along the lines 2—2 and 3—3, respectively, of FIG. 1.

The cross-head 50 is fastened by the nut 52 to the force rod 48 for axial movement and supported by the hub body by surfaces providing plain bearings. A circumferential internal surface 62 along the forward part of the boss portion 56 rides in plain bearing relation on the outer surface of the hub body mount spigot 26, and external surfaces 64 of the aftward part of the cross-head ride on ribs 66 on the aftward hub section 14. The force rod 48 and cross-head 50 are not rotationally affixed to the hub or shafting, but the hub imparts rotation to them through engagement of a bearing pad 67 (see FIG. 2) on one of the boss portions 56 by a crank ring portion 44 of one of the blades.

Figure 3:
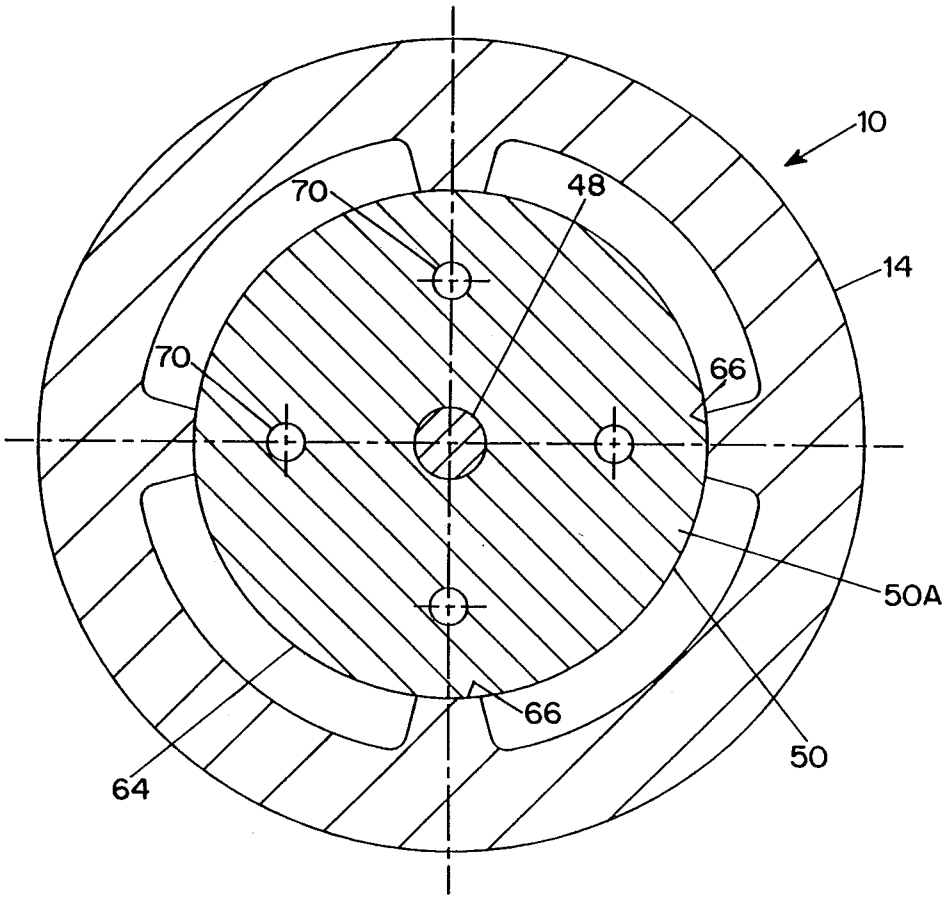

The hub cavity is suitably sealed, as shown, and is filled with grease through capped grease holes 68. The base portion 50A of the cross-head has holes 70 through it to allow the movement of the cross-head through the grease. The grease can also readily displace through the openings between the ribs 66 (see FIG. 3) and the open spaces between the cross-head flange portion 50B and the hub cavity walls (see FIG. 2). The nut 52 is of a uniform cross-sectional area along its length, which area is equal to that of the force rod. Therefore, the volume of the grease-filled cavity of the hub does not change as the tail of the force rod moves in and out of the cavity, because the nut displaces the same volume as the force rod for corresponding intrusions into the grease.

The present invention provides a controllable pitch propeller with a hub that accepts the tail part of the propeller shaft over a major part of its length within the propeller hub inwardly of the blades (the shaft intrudes to a point aft of the blade pivot axes), thereby significantly reducing the complexity of the hub. Moreover, the propeller can be positioned on the vessel with its center of gravity closer to the aftmost shaft bearing than with known designs, which reduces the bending moments in the shaft and the load on the aftmost bearing. The benefits in cost-savings and durability are significant.

I claim:

1. In a controllable pitch marine propeller having a hub body carrying a plurality of propeller blades for rotation about pivot axes disposed radially of the hub axis and adapted to be mounted on the tail end of a tubular propeller shaft, a force rod received within the shaft for movement forward and aftward and extending into the hub body, and a cross-head affixed to the force rod and coupled to each blade by a crank pin and sideway, whereby the blades are rotatable about their pivot axes to alter the blade pitch upon movement of the force rod and cross-head, the improvement wherein the hub body has a generally tubular mount spigot receiving the aft end of the propeller shaft with the spigot and shift terminating aftward of the pivot axes of the blades, the cross-head is generally cup-shaped, having a base portion affixed to the force rod aftwardly of the mounting spigot and the aft end of the shaft and a tubular portion extending forward from the base portion and surrounding aftward portions of the spigot and shaft in telescoping relation, and the cross-head is supported in plain bearing relation for forward-aftward movements by the hub body, including surfaces in the flange portion of the cross-head forming plain bearings with external surfaces of the propeller mounting spigot and external surfaces on the perimeter of the base portion of the cross-head forming plain bearings with internal surfaces of the hub body located aftward of the aft end of the propeller shaft.

* * * * *